United States Patent [19]

Lück

[11] 4,109,332

[45] Aug. 29, 1978

[54] POLYGONAL BODY, CONSISTING OF PLASTICS SOFT FOAM, AS FILLING MATERIAL FOR CUSHIONS OR THE LIKE

[76] Inventor: Werner Lück, In der Wiese 3, 429 Bocholt, Fed. Rep. of Germany

[21] Appl. No.: 761,419

[22] Filed: Jan. 21, 1977

[30] Foreign Application Priority Data

Jan. 24, 1976 [DE] Fed. Rep. of Germany ..... 2602706

[51] Int. Cl.[2] ..... B65D 85/30

[52] U.S. Cl. ..... 5/337; 5/355; 5/361 B; 428/369

[58] Field of Search ..... 428/310, 315, 369, 371, 428/398, 401; 5/355, 337, 361 R; 161/159–162, 168

[56] References Cited

U.S. PATENT DOCUMENTS

| | | | |
|---|---|---|---|
| 2,295,823 | 9/1942 | Banigan et al. | 5/361 R |
| 2,968,857 | 1/1961 | Swerdloff et al. | 428/369 |
| 3,251,728 | 5/1966 | Humbert et al. | 428/369 |
| 3,723,240 | 3/1973 | Skochdopole et al. | 428/369 |
| 3,900,648 | 8/1975 | Smith | 5/355 |

FOREIGN PATENT DOCUMENTS

| | | | |
|---|---|---|---|
| 931,328 | 7/1955 | Fed. Rep. of Germany | 5/361 R |

*Primary Examiner*—Casmir A. Nunberg
*Attorney, Agent, or Firm*—Merchant, Gould, Smith, Edell, Welter & Schmidt

[57] ABSTRACT

A filling material for pillows, cushions and upholstery or the like is cut from a soft plastic foam material in the shape of a plurality of short four-sided rods, each having a body of polygonal shape. The bodies are each cut in such a manner that all side surfaces form surfaces of cut to reduce lumping and tearing of the bodies. Each body is formed with its height smaller than its breadth and its length in the range of one and a half times to five times the breadth, which breadth does not exceed a value of 10 mm. The bodies are each further cut to be rhomboidal in at least transverse cross section to provide surfaces joined at edges to form acute angles so as to enhance resilient properties thereof.

1 Claim, 9 Drawing Figures

POLYGONAL BODY, CONSISTING OF PLASTICS SOFT FOAM, AS FILLING MATERIAL FOR CUSHIONS OR THE LIKE

BACKGROUND OF THE INVENTION

1. Field of the Invention

The invention relates to polygonal bodies consisting of plastics soft foam (for example, polyether with a density between 15 and 40 kg per $m^3$), a multitude of such bodies serving for use as filling material for cushions, upholstery, pillows or the like.

2. Description of the Prior Art

Manufacturers have for a long time endeavoured to replace conventional pillow fillings consisting of natural materials, namely feathers or downs, by synthetic materials in order thereby to render the filled articles less sensitive to moisture, provide better disinfecting and cleaning properties, increase durability, and reduce production costs.

This endeavour has not in the past been successful. Although the cleaning properties were indeed improved by synthetic materials,, the manufacturing costs could not be substantially reduced and, on the other hand, if it was possible to reduce the manufacturing costs, the behavior of the synthetic filling material by no means corresponded to that of natural filling material.

Thus, staple-fibre nonwoven fabrics and continuous-fibre nonwoven fabrics have been used and whilst they improve washability and cleanability they cannot for example be loosened by shaking up, as is possible and necessary in the case of feather pillows in the bedding sector.

In the upholstery sector, entirely synthetic nonwoven fabrics have likewise been tried which, if the necessary strength of resilience or padding is to be achieved, must be used in such amounts that the use is uneconomic, and with which on the other hand the desired relaxing behavior of the cushions cannot be achieved.

The use of cushioning bodies of plastics foam, and which are of short tubular hollow form, is known. These hollow bodies fulfil a part of what is required of the synthetic materials but have the disadvantage that they do not show the behavior resembling feathers or downs, so that such cushioning bodies cannot be used for certain applications.

The use of foam scrap which is torn up into flocks in flock mills and then used as filling is also known. Such flocks have the disadvantage that the filling, by reason of the cell destruction occurring in the edge zone of the flocks, becomes lumpy, i.e. the individual flocks hook on to one another and, after having been in use for a short time, constitute a firmly cohering body which cannot be loosened by shaking up and which does not possess the necessary recovery properties after use.

These disadvantages have been recognized and attempts have been made, by means of so-called "spaghetti" foam strips, to avoid the disadvantages of flocked foam. Such foam coils or foam spaghetti have the disadvantage that they become entangled with one another and, hence, likewise do not possess the necessary property of being able to be loosened by being shaken up. Again, this leads to the formation of lumps or the like inside the pillow and, accordingly, the requirement of such applications are not met.

Thus there has remained the problem of providing a synthetic body which — produced from foam — is suitable for serving, both in the bedding sector and in the upholstery sector, as filling for pillows or cushions and which, in its behavior, approximates more closely to the behavior of natural materials such as downs or feathers.

SUMMARY OF THE INVENTION

According to the invention there is provided a polygonal body of plastics soft foam, for use in filling cushions, upholstery, pillows or the like, wherein the body is in the form of a four-sided rod cut from a foam supply in such a manner that all its side surfaces form surfaces of cut, and wherein its height is smaller than its breadth, and its length is in the range of one and a half times to five times the breadth, which breadth does not exceed a value of 10 mm.

The preferred dimensions of the body (length × breadth × height) are approximately 30 × 8 × 3 mm.

Preferably the four-sided rod is formed as a rhomboid in cross section, i.e, as parallelogram with unequal pairs of sides, so that at two longitudinal edges the side surfaces intersect at acute angles thereby giving the body particular resilient properties. The planar nature of the side areas prevents the bodies from hooking on to one another. In this way a polygonal body is provided which is suitable for use in filling cushions, pillows or the like.

A further proposal of the invention provides that the body be formed as a rhomboid in longitudinal section also.

Bodies according to the invention have been experimentally tested and have demonstrated both excellent cleaning properties and cushioning properties which meet all the requirements demanded.

BRIEF DESCRIPTION OF THE DRAWNGS

Embodiments of the invention will now be described, by way of example only, with reference to the accompanying drawings, in which:

FIG. 1 shows (*a*) in side view, (*b*) in plan view, (*c*) in end view and (*d*) in perspective, a first embodiment of the body according to the invention; and FIG. 2 shows also (*a*) in side view, (*b*) in plan view, (*c*) in end view, and (*d*) and (*e*) in perspective, a second embodiment thereof.

DESCRIPTION OF THE PREFERRED EMBODIMENTS

Figure 1:
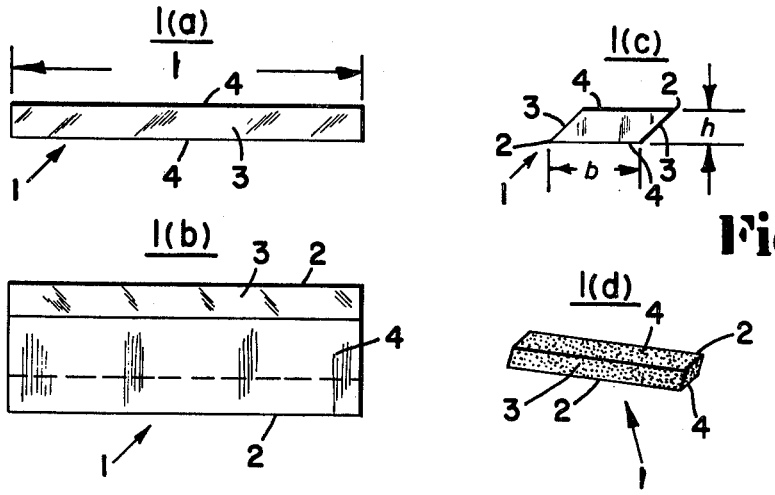
Figure 2:
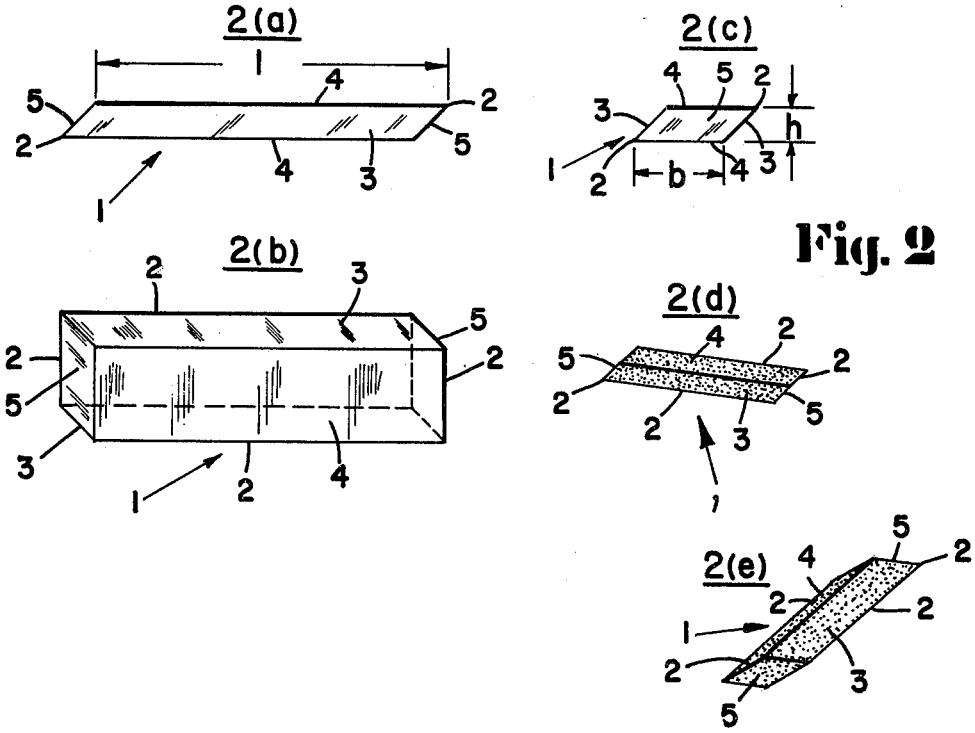

The foam body is designated generally as 1 in FIGS. 1 and 2. Futhermore, in the drawings the length of the body is inscribed as l, the breadth of the body as *b* and the height of the body as *h*. From the view shown in FIG. 1(*c*) it can be seen that the body has a rhomboidal transverse cross section, i.e. a parallelogram with edges 2 formed by the juncture of unequal pairs of opposide sides 3, 4 which define acute angles, while the longitudinal section — from the view shown in FIG. 1(*a*) — forms a rectangle.

In the embodiment of FIG. 2 the longitudinal as well as the transverse section is formed as a rhomboid, so that the number of resilient edges 2 — i.e. where opposite side surfaces 3, 4 and 5 intersect at acute angles — is increased correspondingly.

In this manner body is provided which possesses cleanly cut surfaces 3, 4 or 3, 4 and 5 on all sides in FIGS. 1 and 2 respectively: the cells are therefore not destroyed by tearing thus leaving rough cell edges, and as a result there is simply prevented a lumping together or entanglement with one another of the individual bodies.

In the case of polyether, the individual cells are always open. If other foams are used in which the cells are closed, bodies according to the invention furthermore have the advantage that a multiplicity of cell walls are cut and therefore opened, so that the breathing capacity of the cushion or pillow which is filled with such bodies is considerably improved compared with, for example, one of foam rubber which has closed cell walls.

By means of the invention, a filling body is provided which possesses a good capacity for loosening by shaking up, which exhibits an excellent re-erection capacity, which can be effectively cleaned, and which even after many washings — including boiling — does not lose the aforesaid properties.

What is claimed is:

1. A cushion, pillow, upholstery or the like having a filling comprising a multitude of homogeneous polygonal pieces of plastics soft foam of polyether having a density between 15 and 40 kilograms per cubic meter, wherein each body is in the form of a four sided rod of rhomboidal section longitudinally and transversely, cut from a foam supply in such a manner that all its side surfaces form surfaces of cut, and wherein the height of each body is smaller than the breadth, and the length is in the range of 1½ times to 5 times the breadth, but not greater than approximately 10 millimeters, said length being approximately 30 millimeters, said breadth being approximately 8 millimeters, and said height being approximately 3 millimeters.

* * * * *